US008556075B1

(12) United States Patent
Ou

(10) Patent No.: US 8,556,075 B1
(45) Date of Patent: Oct. 15, 2013

(54) HANGTAG FOR TOOLS

(76) Inventor: Yu-Hua Ou, Taichung (TW)

( * ) Notice: Subject to any disclaimer, the term of this patent is extended or adjusted under 35 U.S.C. 154(b) by 0 days.

(21) Appl. No.: 13/469,439

(22) Filed: May 11, 2012

(51) Int. Cl.
*B65D 85/00* (2006.01)

(52) U.S. Cl.
USPC ..... 206/378; 206/493; 206/372; 211/70.6

(58) Field of Classification Search
USPC ..... 206/372, 378, 376, 377, 375, 373, 806, 206/807, 1.5, 493, 349; 211/70.6, 69.5, 69
See application file for complete search history.

(56) References Cited

U.S. PATENT DOCUMENTS

| | | | | |
|---|---|---|---|---|
| 5,740,911 | A * | 4/1998 | Chou | 206/378 |
| 5,897,001 | A * | 4/1999 | Dembicks | 211/70.6 |
| 5,975,297 | A * | 11/1999 | Kao | 206/378 |
| 6,044,985 | A * | 4/2000 | Kao | 211/70.6 |
| 6,092,655 | A * | 7/2000 | Ernst | 206/378 |
| 6,092,656 | A * | 7/2000 | Ernst | 206/378 |
| 6,401,923 | B1 * | 6/2002 | Huang | 206/376 |
| 6,415,933 | B1 * | 7/2002 | Kao | 211/70.6 |
| 6,644,474 | B1 * | 11/2003 | Lai | 206/378 |
| 6,698,600 | B1 * | 3/2004 | Lee | 211/70.6 |
| 6,854,607 | B2 * | 2/2005 | Tong | 211/70.6 |
| 6,991,105 | B2 * | 1/2006 | Winnard | 206/378 |
| 7,066,339 | B2 * | 6/2006 | Chiu et al. | 211/70.6 |
| 7,118,406 | B2 * | 10/2006 | Mu et al. | 439/419 |
| 7,584,845 | B2 * | 9/2009 | Cheng | 206/376 |
| 8,205,758 | B2 * | 6/2012 | Shih | 211/70.6 |
| 8,307,980 | B1 * | 11/2012 | Kao | 206/378 |
| 2003/0024837 | A1 * | 2/2003 | Chen | 206/378 |
| 2003/0070999 | A1 * | 4/2003 | Kao | 211/70.6 |
| 2003/0102275 | A1 * | 6/2003 | Kao | 211/70.6 |
| 2003/0141211 | A1 * | 7/2003 | Tsai | 206/378 |
| 2004/0188366 | A1 * | 9/2004 | Tong | 211/70.6 |
| 2008/0029420 | A1 * | 2/2008 | Tong | 206/495 |

* cited by examiner

*Primary Examiner* — Steven A. Reynolds
(74) *Attorney, Agent, or Firm* — Muncy, Geissler, Olds & Lowe, PLLC

(57) ABSTRACT

A hangtag for tools includes a suspension element, a positioning element, and a limitation element having a blocker. The positioning element includes a main body and a positioning portion having a base, an elastic piece, and a protrusion disposed on the elastic piece. The base encloses a through slot which penetrates a top and a bottom of the base and extends through a side face of the main body to reach inside of the main body. The elastic piece laterally extends into the through slot from the main body, and a shifting room is defined by the elastic piece and the through slot. When the blocker is in the shifting room and leans against the elastic piece, the protrusion is at a first position, and security is provided by the elastic piece. When the blocker doesn't lean against the elastic piece, sockets can be easily removed.

5 Claims, 7 Drawing Sheets

HANGTAG FOR TOOLS

BACKGROUND OF THE INVENTION

1. Field of the Invention

The present invention relates to a display device, more specifically to a hangtag for displaying sockets.

2. Description of the Prior Art

Some hand tools are able to drive different target objects by employing different sockets. Thus, sockets are able to be sold independently. Manufacturers usually put sockets in different sizes on a hangtag for displaying.

However, sockets are small and easy to be stolen. To prevent from being stolen, conventional hangtags usually have anti-theft mechanisms. For example, a conventional hangtag includes a suspension board, a hanger, and a fixation piece. The hanger forms a limitation portion on its bottom, and a through hole is formed on the limitation portion. A buckle portion is formed on a top of the fixation piece, and a stopping protrusion is formed on an edge of a bottom of the fixation piece. An engaging hole and an internal hole are formed axially in a socket, wherein the engaging hole communicates with the internal hole. When the limitation portion is engaged with the engaging hole, the socket is detachably disposed on the limitation portion. After that, the fixation piece is inserted into the internal hole, and the buckle portion further penetrates through the through hole of the limitation portion and is fixed to the limitation portion. At the same time, the stopping protrusion abuts against the ladder edge between the engaging hole and the internal hole. Thus, the socket is unable to be removed from the limitation portion and is prevented from being stolen.

Nevertheless, conventional hangtags are adapted for only the sockets whose engaging hole and internal hole communicate with each other.

Moreover, the fixation piece is fixed to the limitation portion and is unable to be removed from the limitation portion. It is inconvenient that the buckle portion should be cut off in advance with a scissor or other tools to release the socket before using. Also, the hangtag is unable to receive sockets anymore.

Besides, the limitation portion has a predetermined thickness, so that the limitation portion and the buckle portion are difficult to be cut off. Also, the buckle portion is disposed on the incline faces of two sides of the limitation portion, so that blades of scissor may slip on the incline faces to increase difficulty of operating.

The present invention is, therefore, arisen to obviate or at least mitigate the above mentioned disadvantages.

SUMMARY OF THE INVENTION

The main object of the present invention is to provide a hangtag for tools with anti-theft mechanism, wherein the anti-theft mechanism doesn't have to be damaged before removing sockets.

To achieve the above and other objects, a hangtag for tools of the present invention includes a suspension element, a positioning element, and a limitation element, wherein the suspension element forms a suspension hole.

The positioning element includes a main body and at least one positioning portion, wherein the main body extends from the suspension element. The main body has a first face and an opposite second face. The positioning portion includes a base, an elastic piece, and a protrusion. The base laterally extends from a side face of the main body. The base encloses a through slot which penetrates a top and a bottom of the base and further extends through the side face of the main body to reach inside of the main body. Thus, the base is hollow. The elastic piece includes an extending section and a leaning portion. The extending section laterally extends into the through slot from the main body, and a shifting room is defined by a bottom of the extending section and a part of the through slot. The leaning portion is located on an end of the extending section away from the main body, and the protrusion is formed on a top of the leaning portion and protrudes above the top of the base.

The limitation element is alternatively fixed to the second face of the main boy, and the limitation element further includes at least one blocker.

When the limitation element is fixed to the second face of the main body, the blocker is in the shifting room and leans against a side face of the leaning portion near the extending section to be positioned at a first position. When the limitation element is away from the second face of the main body, the blocker leaves the shifting room and doesn't lean against the leaning portion. Thus, the protrusion is able to move between the first position and a second position. Besides, the protrusion tends to move toward the first position due to the elastic force provided by the elastic piece.

Thereby, the sockets can be positioned or be removed easily due to the elastic piece and the protrusion. More importantly, when the limitation element is fixed on the second face of the main body, the limitation element can be used as an anti-theft mechanism. On the contrary, when the limitation element is away from the second face of the main body, the socket can be removed easily. Hence, the hangtag for tools of the present invention can be not only a display device but also a receiving device for receiving sockets.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 5:
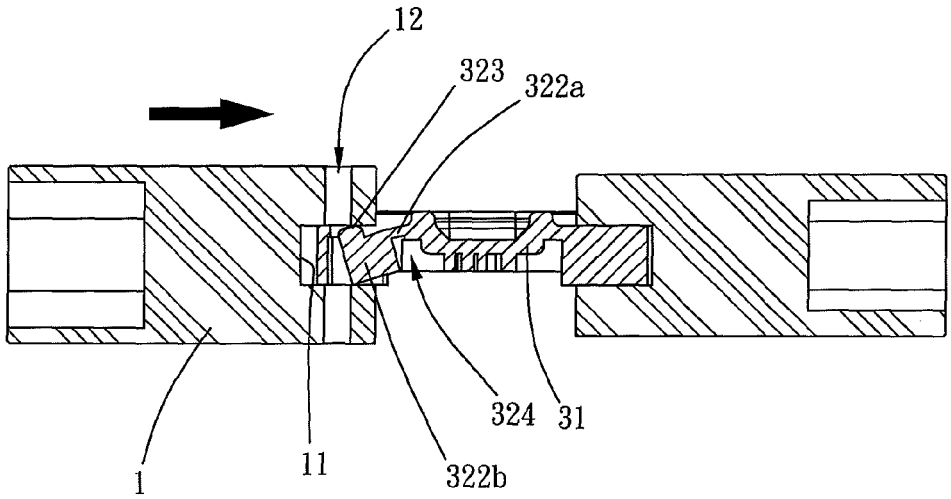
FIG. 5 is an illustration of operating of the present invention, wherein the protrusion is driven to the second position by the elastic piece.

Please refer to FIG. 5, the hangtag for tools of the present embodiment is provided for position a tool. In the major embodiment of the present invention, the tool is a socket 1, more especially a socket for a pneumatic tool. An engaging hole 11 is formed axially on an end of the socket 1, and a through hole 12 is formed radially on the socket 1 which communicates with the engaging hole 11 and penetrates a side wall of the socket 1. However, the tool is not limited to the socket of the previous embodiment, and any tool with similar structure can be employed to the hangtag for tools of the present invention.

Please refer to FIG. 1 to FIG. 4 and FIG. 6, the hangtag for tools of the present invention includes a suspension element 2, a positioning element, a limitation element 4, and a fixing means.

The suspension element 2 forms a suspension hole 21 which is provided for inserted by a hook or a rod (not shown in drawings), so that the suspension element 2 is able to be hung on wall or a display. The suspension element 2 has a front face and an opposite rare face, wherein a pair of pivoting ears 22 are formed on the rare face.

The positioning element includes a main body 31 and a plurality of positioning portions. The main body 31 extends from an end of the suspension element 2 and has a first face and an opposite second face. In the major embodiment, the main body 31 is a cuboid. Thus, the main body 31 includes two opposite side faces which are located between the first face and the second face. When the hangtag for tools of the present invention is hung on wall or a display, the front face of the suspension element 2 and the first face of the main body 1 are oriented frontward.

Figure 8:
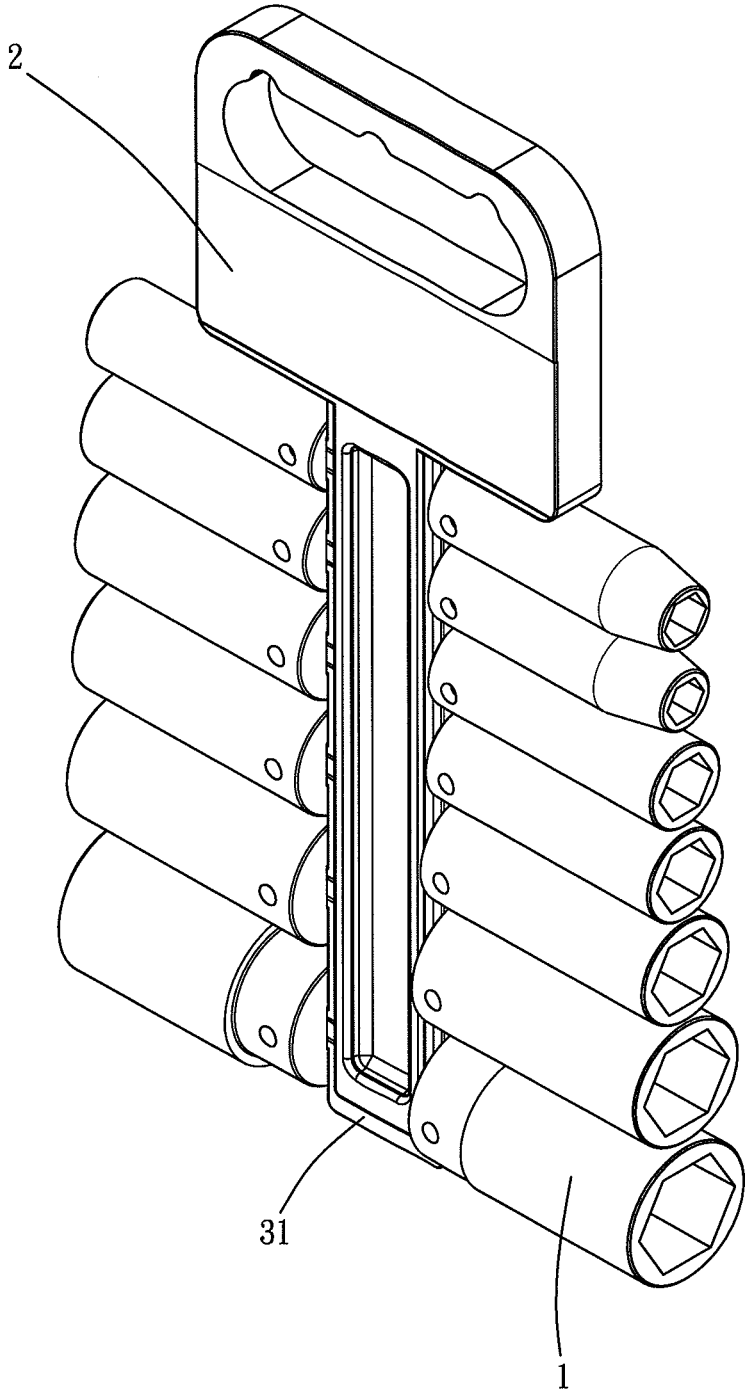
FIG. 8 is a stereogram showing the hangtag for tools for adapted for a plurality of sockets of the present invention.

The positioning portions are formed on the two side faces of the main body 31 respectively, and the positioning portions on the same side face are arranged spacedly but nonequidistantly. Thus, the hangtag for tools of the present invention can be provided to receive sockets 1 with various sizes, wherein the sockets 1 are arranged spacedly, as shown in FIG. 8. Besides, each positioning portion has a base 321, an elastic piece 322, and a protrusion 323. The base 321 laterally extends from the main body 31, and the base 321 encloses a through slot 321*a* which penetrates a top and a bottom of the base 321 and extends through the side face of the main body 31 to reach inside of the main body 31. Thus, the base 321 is hollow. The elastic piece 322 includes an extending section 322*a* and a leaning portion 322*b*. The extending section 322*a* laterally extends into the through slot 321*a* from the main body 31, and the leaning portion 322*b* is located on an end of the extending section 322*a* away from the main body 31. In other words, the extending section 322*a* is located between the main body 31 and the leaning portion 322*b*, and a shifting room 324 is defined by a bottom of the extending section 322*a* and a part of the through slot 321*a* of the base 321. The leaning portion 322*b* includes a top, a bottom, and a side face. The protrusion 323 is disposed on the top of the leaning portion 322*b* and protrudes above the top of the base 321. Also, an extending direction of the protrusion 323 is perpendicular to an extending direction of the main body 31, so that the protrusion 323 and the first face of the main body 31 have the same orientation. On the other hand, a top of the protrusion 323 is arc-shaped.

The limitation element 4 is alternatively fixed to the second face of the main body 31. In the major embodiment of the present invention, the limitation element 4 is slice-shaped and includes two pivot portions 41. The two pivot portions 41 are pivotably disposed on the two pivoting ears 22 to enable the limitation element 4 to pivot with respect to the main body 31 between an open position and a fixed position. In other possible embodiment of the present invention, the limitation element 4 is pivotably disposed on the second face of the main body 31.

Figure 7:
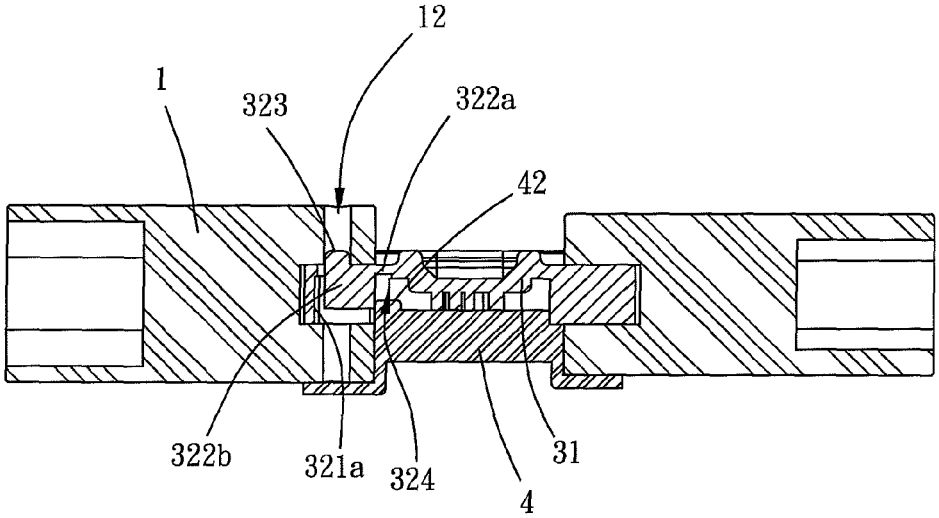
FIG. 7 is a bottom-viewed cross-section drawing of FIG. 1, wherein the limitation element leans against the elastic piece to position the protrusion at the first position.

The limitation element 4 includes a plurality of blockers 42 and support portions 43. Each blocker 42 protrudes a side of the limitation element 4 near the main body 31, and each blocker 42 positionally corresponds to one of the bases 321. More specifically, when the limitation element 4 is at the fixed position, the limitation element 4 is fixed on the second face of the main body 31 by the fixing means. At the same time, each blocker 42 is located in the through slot 321*a* of corresponding base 321. More particularly, each blocker 42 is located in the shifting room 324 and abuts against a side face of the leaning portion 322*b* near the extending section 322*a*. Preferably, an intersecting corner is located between a bottom of the leaning portion 322*b* and the side face of the leaning portion 322*b* near the extending section 322*a*, and each protrusion 323 is formed at a corner opposite to the intersecting corner. The blocker 42 leans against a part of the side face near the extending section 322*b* and the intersecting corner, as shown in FIG. 7.

The support portions 43 have shape corresponding to shape of tools. Please refer to FIGS. 1 and 3, in the major embodiment of the present invention, the support portions 43 have shape corresponding to shape of sockets in various sizes. More specifically, although the sockets have a variety of sizes, outlines of sockets are still cylinder-shaped. Thus, the support portions 43 form a wavy appearance. In addition, when the sockets are positioned on the positioning element, and the limitation element 4 is at the fixed position, the support portions 43 abut against the sockets 1. Hence, the sockets 1 are able to be supported well by the support portions.

Figure 2:
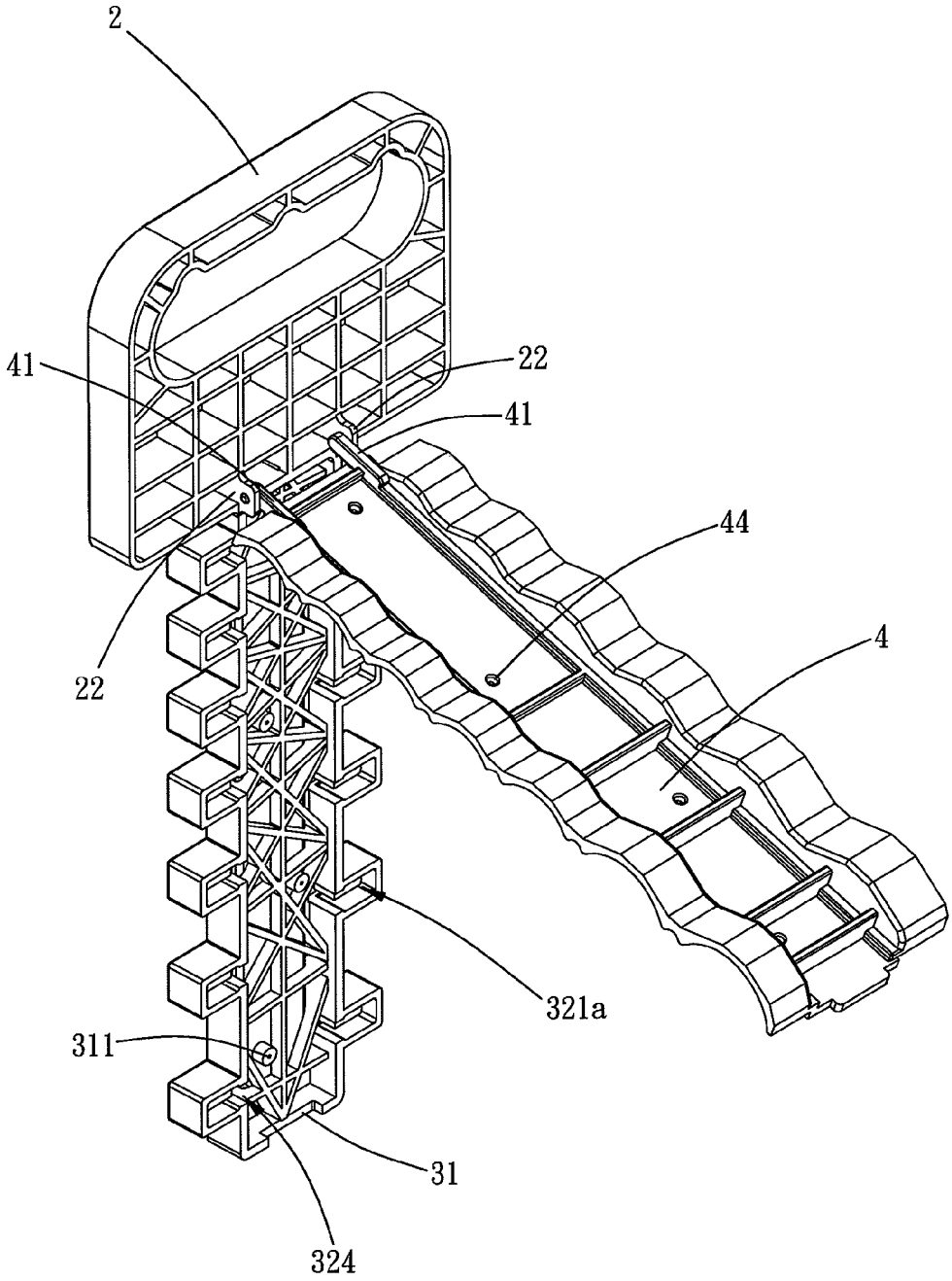
FIG. 2 is a stereogram at another viewpoint of the present invention, wherein the limitation element is pivoted to an open position.
Figure 3:
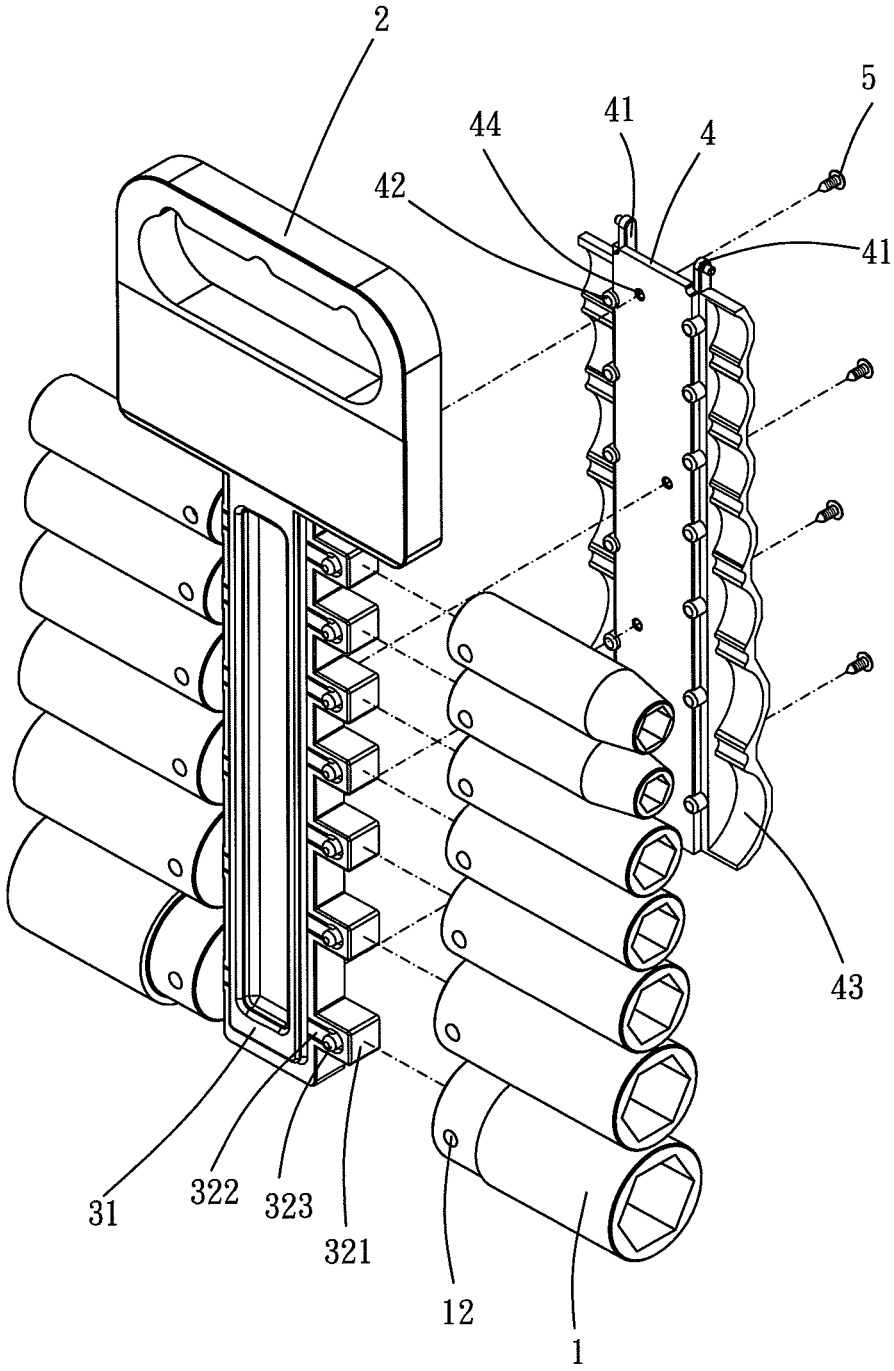
FIG. 3 is a breakdown drawing of the present invention.

Please refer to FIGS. 2 and 3, in the major embodiment, the hangtag for tools of the present invention further includes a plurality of screwing element 5. Also, a plurality of fixing portions 311 are formed on the second face of the main body 31, and a plurality of fixing holes 44 are formed on the limitation element 4. When the limitation element is at the fixed position, the screwing elements 5 are inserted through the fixing holes 44 and are screwed with the fixing portions 311 (not shown in drawings). Thus, the limitation element 4 is fixed on the second face of the main body 31. In other possible embodiment, a buckle portion is formed on one of the main body 31 or the limitation element 4, and a recess flute is formed on the other one of the main body 31 or the limitation element 4. When the limitation element 4 is at the fixed position, the buckle portion is embedded in the flute, so that the limitation element 4 is fixed on the second face of the main body 31.

Figure 4:
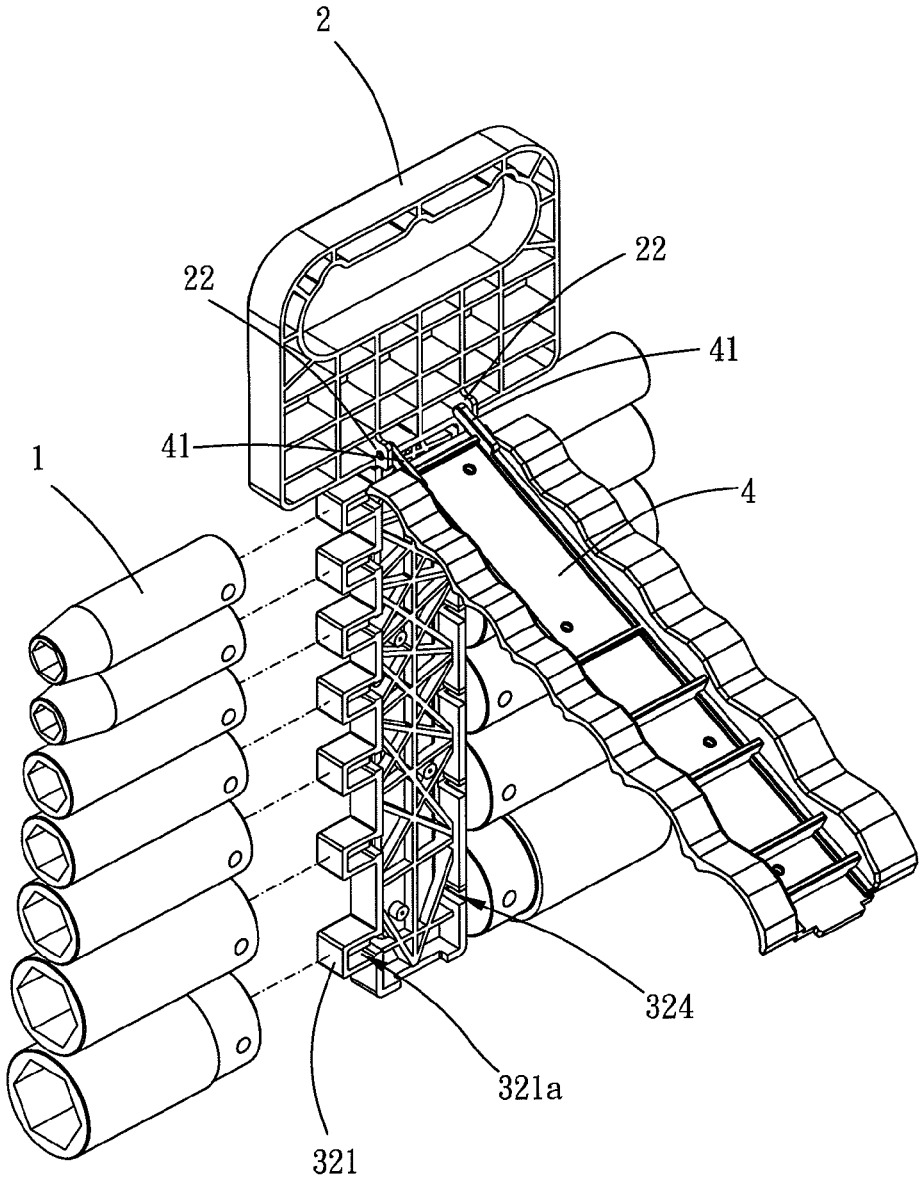
FIG. 4 is an illustration showing the hangtag for tools which is adapted for sockets of the present invention.

Please refer to FIGS. 4 and 5, in practice, the limitation element can be pivoted to the open position, so that the limitation element 4 is away from the second face of the main body 31. And then, the engaging hole 11 of the socket is faced to one of the positioning portion, so that the socket 1 is able to slide along the base 321 of the positioning portion toward the main body 31. At the same time, the socket 1 can abut against the protrusion 323 to enable the protrusion 323 to move to the second position from the first position. Please refer to FIG. 5, when the protrusion 323 is at the second position, the leaning portion 322*b* is also shifted, and the extending section 322*a* is slightly bent toward the shifting room 324 to provide elasticity to the protrusion 323. Hence, the protrusion 323 tends to move toward the first position. Please refer to FIG. 7, when the through hole 12 positionally corresponds to the protrusion 323, the protrusion 323 moves back to the first position and inserts into the through hole 12. Thus, the socket 1 is positioned on the positioning portion.

Figure 1:
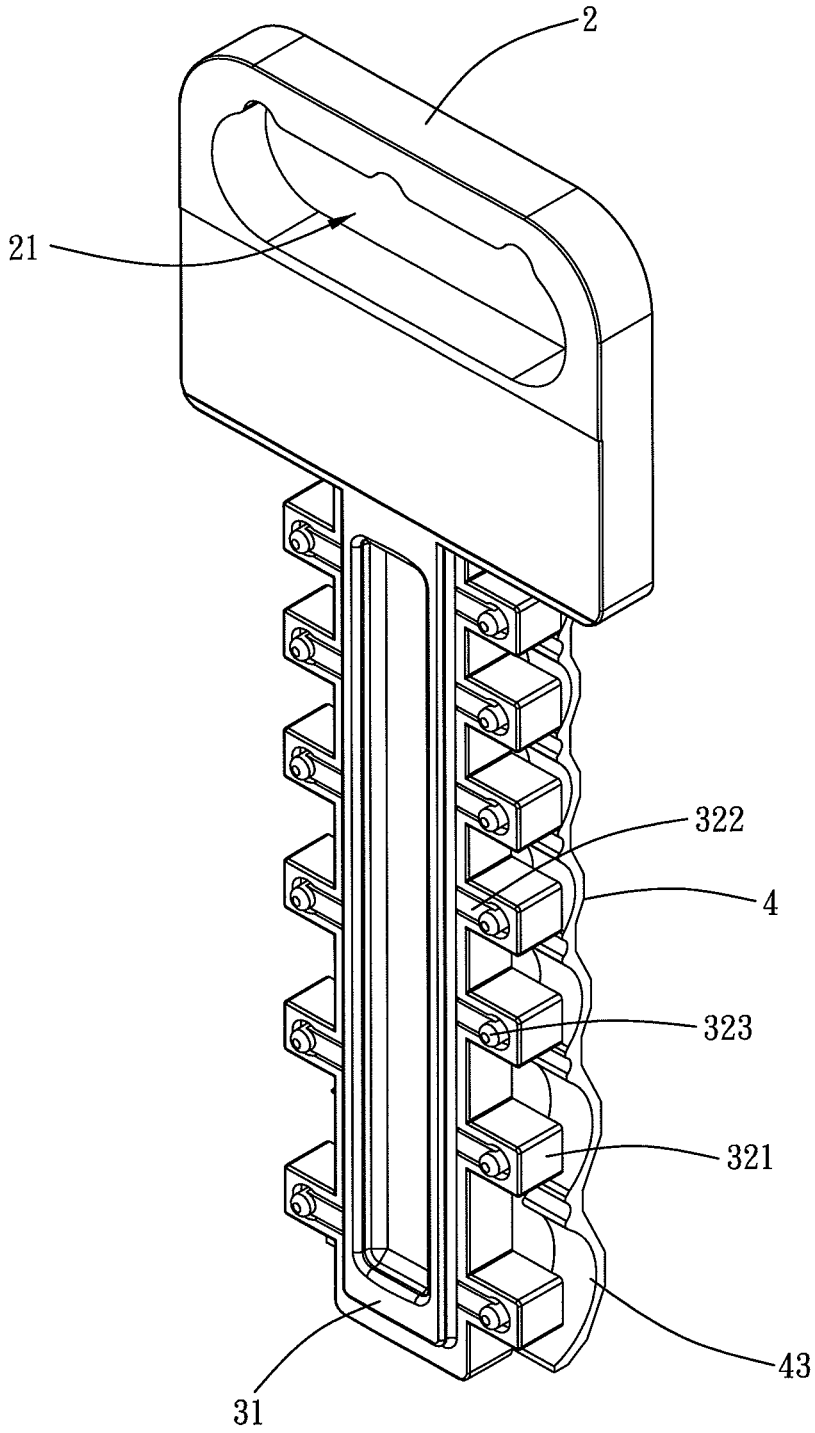
FIG. 1 is a stereogram of the present invention.
Figure 6:
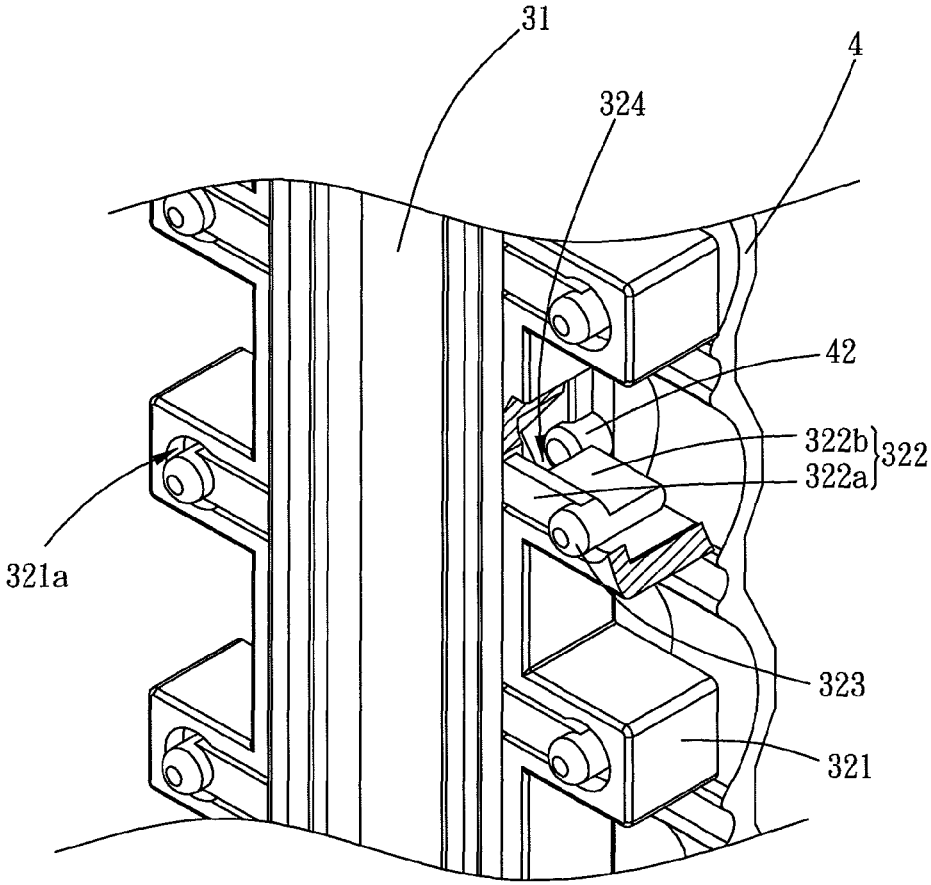
FIG. 6 is a partial enlargement perspective drawing of FIG. 1, wherein the blocker of the limitation element leans against the leaning portion of the elastic piece.

Moreover, please refer to FIGS. 1, 6, and 7, a user can pivot the limitation element 4 to the fixed position and position the limitation element 4 on the second face of the main body 31. Thus, the blocker 42 is located in the shifting room 324 and abuts against the part of the side face near the extending section 322*a* and the intersecting corner. In other words, a shifting path of the leaning portion 322*a* is blocked by the blocker 42, so that the leaning portion 322*b* is unable to move. Furthermore, the extending section 322*a* is unable to be bent, so that the protrusion 323 is fixed at the first position, and also in the through hole 12 of the socket. Thereby, the socket 1 is unable to be removed from the hangtag for tools of the present invention.

Besides, when a user want remove the socket 1, he can just pivot the limitation element 4 to the open position, so that the blocker 42 is able to leave the shifting room 324 and doesn't abut against the leaning portion 322*b* of the elastic piece, as shown in FIG. 5. At the same time, the leaning portion 322*b* is not restricted by the blocker 42 anymore, and the protrusion 323 is able to move between the first position and the second position. Thereby, the socket 1 can be easily removed from the positioning portion.

In conclusion, sockets 1 can be positioned on or be removed from the positioning portions of the hangtag for tools of the present invention by sliding, and theft-preventing can be provided by the limitation element 4. More importantly, a customer who bought the socket can easily remove the socket from the hangtag by removing the fixing means and by pivoting the limitation element to the open position. Thus, the limitation element doesn't have to be broken, so that the hangtag for tools of the present invention can be also a receiving device for tools.

What is claimed is:

1. A hangtag for tools, comprising:

a suspension element, forming a suspension hole;

a positioning element, including a main body and at least one positioning portion, the main body extending from the suspension element and including a first face and a opposite second face, the at least one positioning portion having a base, an elastic piece, and a protrusion, the base laterally extending from a side face of the main body, the base encloses a through slot, the through slot penetrating a top and a bottom of the base and extending through the side face of the main body to reach inside of the main body, the main body being thereby hollow, the elastic piece including an extending section and a leaning portion, the extending section laterally extending into the through slot from the main body, a shifting room being defined by a bottom of the extending section and a part of the through slot, the leaning portion being located on an end of the extending section away from the main body, the protrusion being disposed on a top of the leaning portion and protruding above the top of the base;

a limitation element, being alternatively fixed to the second face of the main body and including at least one blocker;

wherein when the limitation element is fixed to the second face of the main body, the blocker is located in the shifting room and leans against a side face of the leaning portion near the extending section to be positioned at a first position;

wherein when the limitation element is away from the second face of the main body, the blocker leaves the shifting room and is away from the leaning portion, the protrusion is movable between the first position and a second position and tends to move toward the first position due to an elastic force provided by the extending section of the elastic piece.

2. The hangtag for tools of claim 1, wherein an intersecting corner is located between a bottom of the leaning portion and the side face of the leaning portion near the extending section, the blocker leans against a part of the side face near the extending section and the intersecting corner when the limitation element is fixed to the second face of the main body.

3. The hangtag for tools of claim 2, wherein the protrusion is formed at a corner opposite to the intersecting corner.

4. The hangtag for tools of claim 1, wherein an end of the limitation element is pivotably disposed on the suspension element to enable the limitation element to pivot with respect to the main body of the positioning element between an open position and a fixed position, the limitation element is fixed to the second face of the main body and the blocker leans against the leaning portion when the limitation element is at the fixed position.

5. The hangtag for tools of claim 1, wherein the limitation element includes at least one support portion which has a shape corresponding to a shape of a tool, the support portion provides support to the tool when the tool is disposed on the positioning element and the limitation element is fixed to the second face of the main body.

* * * * *